US011644180B2

(12) United States Patent
Van Kempen

(10) Patent No.: US 11,644,180 B2
(45) Date of Patent: May 9, 2023

(54) ILLUMINATION DEVICE, LUMINAIRE AND REFRIGERATOR

(71) Applicant: SIGNIFY HOLDING B.V., Eindhoven (NL)

(72) Inventor: Frank Walterus Franciscus Marie Van Kempen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/787,822

(22) PCT Filed: Dec. 21, 2020

(86) PCT No.: PCT/EP2020/087438
§ 371 (c)(1),
(2) Date: Jun. 21, 2022

(87) PCT Pub. No.: WO2021/136709
PCT Pub. Date: Jul. 8, 2021

(65) Prior Publication Data

US 2023/0026590 A1 Jan. 26, 2023

(30) Foreign Application Priority Data

Jan. 2, 2020 (EP) ..... 20150009

(51) Int. Cl.
*F21V 5/04* (2006.01)
*F21S 4/28* (2016.01)
(Continued)

(52) U.S. Cl.
CPC ..... *F21V 5/043* (2013.01); *F21S 4/28* (2016.01); *F21W 2131/305* (2013.01); *F21Y 2115/10* (2016.08)

(58) Field of Classification Search
CPC ..... F21V 5/043; F21S 4/28; F21W 2131/305; F21Y 2115/10
See application file for complete search history.

(56) References Cited

U.S. PATENT DOCUMENTS 6,911,659 B1 * 6/2005 Malo ..... G02B 6/02123 250/492.1
9,435,920 B2 9/2016 Schlueter
(Continued)

FOREIGN PATENT DOCUMENTS

CN 104676366 A 6/2015
DE 202009013230 U1 2/2011
(Continued)

*Primary Examiner* — Evan P Dzierzynski

(57) ABSTRACT

The invention relates to an illumination device comprising a domeshaped, cylindrical lens (7) having an optical focal line (19) and a plurality of light sources (3) arranged along the focal line and configured to emit light during operation. Said lens being disposed to receive and to deflect said light as a light beam having an angle y in a transverse direction, wherein 0'<=$_7$<=30'. In transversal cross section the cylindrical lens comprises a central portion (21) flanked by a first side portion (23) and a second side portion (25). The illumination device further comprises an axially extending screen (27) disposed adjacent to the first side portion; and an axially extending diffuser (33) provided at the second side portion.

13 Claims, 5 Drawing Sheets

(51) Int. Cl.
*F21Y 115/10* (2016.01)
*F21W 131/305* (2006.01)

(56) References Cited

U.S. PATENT DOCUMENTS

| | | | | |
|---|---|---|---|---|
| 2010/0020542 | A1* | 1/2010 | Teng | F21V 15/015 362/249.05 |
| 2013/0201675 | A1* | 8/2013 | Linehan | F21V 15/013 362/217.05 |
| 2013/0293098 | A1 | 11/2013 | Li et al. | |
| 2014/0254134 | A1* | 9/2014 | Pelka | F21V 5/04 362/311.08 |
| 2019/0186710 | A1 | 6/2019 | Lim et al. | |

FOREIGN PATENT DOCUMENTS

| | | | |
|---|---|---|---|
| DE | 202016002197 | U1 | 6/2016 |
| WO | 2014195144 | A1 | 12/2014 |
| WO | 2016162849 | A1 | 10/2016 |
| WO | 2017211579 | A1 | 12/2017 |

* cited by examiner

ILLUMINATION DEVICE, LUMINAIRE AND REFRIGERATOR

CROSS-REFERENCE TO PRIOR APPLICATIONS

This application is the U.S. National Phase application under 35 U.S.C. § 371 of International Application No. PCT/EP2020/087438, filed on Dec. 21, 2020, which claims the benefit of Europe Patent Application No. 20150009.7, filed on Jan. 2, 2020. These applications are hereby incorporated by reference herein.

FIELD OF THE INVENTION

The invention relates to an illumination device, a luminaire comprising said illumination device, and a refrigerator comprising said illumination device and/or said luminaire.

BACKGROUND ON THE INVENTION

The present invention relates generally to an illumination device for providing a uniform light distribution, and particularly for uniformly illuminating walls as shelve lighter, wall washer or for illumination of merchandise on long shelves in a refrigerator compartment. A prominent means of lighting long store-shelves is the retrofit T-LED lamp as a more economical substitution for the fluorescent lamp which was typically used for shelf lighting in refrigerators. Light emitting diodes have a higher efficacy at low temperatures typically for application in freezers, and longer operational life (e.g., 50,000-100,000 hours) at low temperature in comparison to fluorescent tubes. The major advantages of longer life, lower power consumption, higher efficacy at lower temperatures, as well as compact package size make LEDs a typical desirable light source for illuminating supermarket freezers. The linear geometry of the T-LED lamp is appropriate for long shelves, as the lighting adequately illuminates the merchandise within the compartment. Yet, it appears cumbersome to provide a T-LED in a frame of a refrigerator due to the still relatively bulky size of the T-LED compared to the frame. Substitution of the T-LED by a basic LED-strip is therefore desired. Such LED-strips can be economically provided as low-cost LEDs on low-voltage tapes, with LED dies typically spaced every 10-20 mm Because LEDs typically radiate into a hemisphere, optical lensing has to be employed to distribute their light output and to collimate/deflect the (typically Lambertian) emitted beam of the LEDs into a relatively narrow beam. Usually, such optics have been mounted individually on the LEDs as domes, however, nowadays also a cylindrical, continuous lens that extends over a plurality of LEDs of the LED-strip is used. However, it appeared that, also with used of such a cylindrical lens, illumination by such LED strips involves various disadvantages. For example, when mounted as the light source in the door frame of the refrigerator, leads to customer complaints about the dotty appearance of the light source, sometimes referred to as "Christmas tree". This appearance of the light source gives potential buyers/customers the impression of cheap, low quality merchandise being exposed in the refrigerators and furthermore leads to undesired distraction of said customers because of glare. As a remedy to avoid the unpleasant visible, dotty appearance of the LED strip, it can be screened from direct view by an additional relatively large glare shield, which however, involves the disadvantages of having a detrimental effect of lower efficacy of the illumination device as it also blocks useful light for shelf/product illumination, and rendering the disadvantage of the illumination device becoming relatively expensive and bulky.

SUMMARY OF THE INVENTION

It is an object of the invention to provide an illumination of the type as described in the opening paragraph in which at least one of the abovementioned disadvantages is counteracted. Thereto the illumination device comprises:

- a dome-shaped, cylindrical lens having an optical focal line defining a main axis;
- a plurality of light sources arranged along the main axis and configured to emit light during operation;

said lens being disposed to receive and to deflect said light as a light beam having at FWHM an angle $\gamma$ in a direction transverse to the main axis, wherein preferably $0° <= \gamma <= 45°$, in transversal cross section the cylindrical lens comprises a central portion flanked by a first side portion and a second side portion;

- an axially extending screen disposed adjacent to the first side portion; and
- an axially extending diffuser provided at the second side portion, wherein the cylindrical lens comprises an inner lens surface facing towards the plurality of light sources and an outer lens surface facing away from the light sources and wherein the diffuser is at least provided on the outer lens surface.

Full Width at Half Maximum, i.e. FWHM, in this context is the width of the light beam measured between those points on that are on half the maximum intensity of the beam. The present invention preferably is LED-strip based and will remedy the current lack of suitable illumination for uniform-illuminance LED shelf-lights. The inventors found that the unpleasant dotty appearance is the result of reflection of individual LED-dies at the surface of the cylindrical lens at said second side required for shaping the light emitted by the LEDs into a desired, narrow beam. Hence, customers do not have a direct view of the individual LEDs, as these are screened from direct view by a screen, for example formed by the frame of the door of the refrigerator, but the customers appeared to suffer from glare caused by viewing reflected images of individual LEDs in the surface at said second side of the cylindrical lens Said second side typically is not shielded from direct view by the frame of the refrigerator door as this would render the frame to become too large. The provision of an axially extending, reflective diffuser provided at the second side portion of the lens blurs or diffuses the dotty appearance of the reflected images of the LEDs, thus reducing the undesired "Christmas tree" effect and lowering the glare. It is counter-intuitive to provide a diffuser at a collimating lens that is designed to narrow a beam from a Lambertian light emitter, as a diffuser generally causes broadening of the beam. Yet, it appeared that providing the diffuser at the specified location at the lens, i.e. at the second side portion, that the broadening effect of the diffuser is acceptably small and yet that a satisfactorily blurring effect of the dotty appearance of the LEDs is obtained. A transverse direction may, for example, be in a direction perpendicular to the main axis, such as a transverse cross-section may be a cross section perpendicular to the main axis. In the context of the invention, the expression extending along the main axis may be interpreted as extending next to, such as parallel to the main axis or may be interpreted as to coincide with the main axis. Typically suitable lens materials are, for example, polymethylmethacrylate (PMMA), polycarbonate (PC), polyethylene-terephthalate (PET) and polyethylene (PE). The light beam having at FWHM an angle γ in a direction transverse to the main axis preferably is 0°<=γ<=45, as wider than 45° enhances the risk on excessive spill light.

The illumination device has the feature that the cylindrical lens comprises an inner lens surface facing towards the plurality of light sources and an outer lens surface facing away from the light sources and wherein the diffuser is at least provided on the outer lens surface. It appeared that especially this specified location of the diffuser area at the outer surface favourably combines the effects of counteracting the dotty appearance with an only slight broadening of the deflected, narrow light beam. Furthermore, it renders the illumination device to be relatively compact, while yet the desired combined effects are obtained. The diffuser may be provided only on the outer surface of the lens, but, additionally, the illumination device may have, for example, the feature that it further comprises a reflector having a reflective surface facing towards the lens, wherein said reflector is arranged adjacent to the second side portion and wherein the diffuser is provided on said reflective surface.

The illumination device may have the feature that each of the plurality of light sources is positioned on the focal line and each light source has a respective optical axis extending through the cylindrical lens in a direction transverse to the main axis. The deflection of the emitted Lambertian beam profile by the LEDs then is relatively effective for transforming said beam into the desired narrow beam.

The illumination device may have the feature that with respect to rotation over the focal line, the dome shaped lens extends over the plurality of light sources over angle α, wherein 90°<=α<=160°. The larger the angle α, e.g. up to 180°, yet in practice 160° will do, the better the lens is enabled to capture and deflect the light emitted by the LEDs, the more efficient the illumination device will be. Yet, on the other hand the lens is as small as possible, i.e. not less than 90°, to save cost and weight and to render the illumination device to be compact.

The illumination device may have the feature that the first side portion has an axially extending first outer edge, and that with respect to rotation over the focal line the screen screens the dome from the first outer edge over an angle ß, wherein 10°<=ß<=50°. The shielding over such an angle ß renders the screen to be relatively small and yet effective is shielding the LEDs from direct view. A larger screen is not necessary as the distracting indirect view, i.e. the visibility of dotted reflection images of the LEDs at the second side portion of the cylindrical lens is counteracted by the axially extending diffuser at said second side portion.

The illumination device may have the feature that the second side portion has an axially extending second outer edge and wherein with respect to rotation over the focal line the diffuser forms a diffuser area which starts at angle φ from said second outer edge, wherein 0°<=φ<=40°, and wherein the diffuser area extends over angle Θ, wherein 5°<=Θ=15°. It appeared that especially this specified diffuser area is effective in counteracting the dotty appearance in combination with only a slight broadening of the deflected, narrow light beam. In particular it appeared that in some embodiments 10°<=φ<=30° and 8°<=Θ<=12° provides a well-balanced and effective desired result both in illumination, shielding and counteracted dotty appearance.

The illumination device may have the feature that the diffuser comprises at least one of a white powder coating, a white tape, a white spray-coating, a sandblasted and an etched surface structure. These are typical and convenient forms of providing and applying diffusers onto optical surfaces and adjacent to optical surfaces.

The illumination device may have the feature that the cylindrical lens is an extruded lens and wherein the diffuser is a co-extruded component. This is a preferred manufacture method, for example over injection molding of lenses on which a diffuser is to be applied afterwards in a separate process step, as it is a relatively cheap, accurate and fast way to manufacture continuous, elongated, cylindrical lenses, which involves the further advantage that it enables to cut the cylindrical lens to size. Typically extrudable, suitable lens materials are PMMA and PC, wherein the co-extruded diffuser is of the same carrier material as the lens but then locally doped with scattering particles such as, for example, TiO2, Al2O3, ZrO2 or SiO2 particles.

The illumination device may have the feature that the diffuser is an anisotropic diffuser having a degree of diffusion in the main direction higher than the degree of diffusion in the transverse direction. This renders the illumination device to have the advantage that essentially only the dotty appearance of the illumination device is counteracted while beam broadening in the transverse direction is essentially absent, thus rendering the illumination device to be even more effective.

The illumination device may have the feature that the diffuser has a beam widening effect of widening the beam by an angle δ, wherein 1°<=δ<=5°. It appeared that under practical circumstances such a beam broadening is effective in counteracting the dotty appearance while the negative effect of beam broadening on the desired illumination profile of merchandise on shelves is acceptably low.

The invention further relates to a luminaire comprising a housing accommodating the illumination device according to the invention and further comprising fixation means for mounting the luminaire to a carrier. The luminaire, for example, can be mounted into the door frame of a refrigerator or can be mounted onto a wall or ceiling for being applied as a light wall washer.

The invention still further relates to a refrigerator comprising a refrigerator door frame, a refrigerator compartment comprising at least one shelve and lidded by a refrigerator door, wherein the illumination device according to the invention or the luminaire according to the invention which is mounted onto a first vertical post of the door frame for illuminating from a first direction a front part of the shelve closest to the refrigerator door.

The refrigerator may have the feature that it comprises a further illumination device and/or a luminaire according to the invention, which is mounted onto a second vertical post, opposite to the first vertical post, for illuminating from a second direction, opposite to the first direction, the front part of the shelve closest to the refrigerator door. Thus it is possible to illuminate from both sides the merchandise on shelves of the refrigerator enabling the merchandise to be presented in a more attractive manner to customers. Each illumination device can be individually controllable, with each LED thereof can be individually controllable as well, a desired color distribution and light intensity distribution can be chosen for optimal illumination of the displayed merchandise.

BRIEF DESCRIPTION OF THE DRAWINGS

The invention will now be further explained by means of the schematic drawings which are not drawn up to scale and in which dimensions of some features may be exaggerated for the sake of explanation. The drawings are by no means intended to limit the scope of the invention but rather are intended to exemplify the ample possibilities of the invention. In the drawings.

DESCRIPTION OF PREFERRED EMBODIMENTS

Figure 1A:
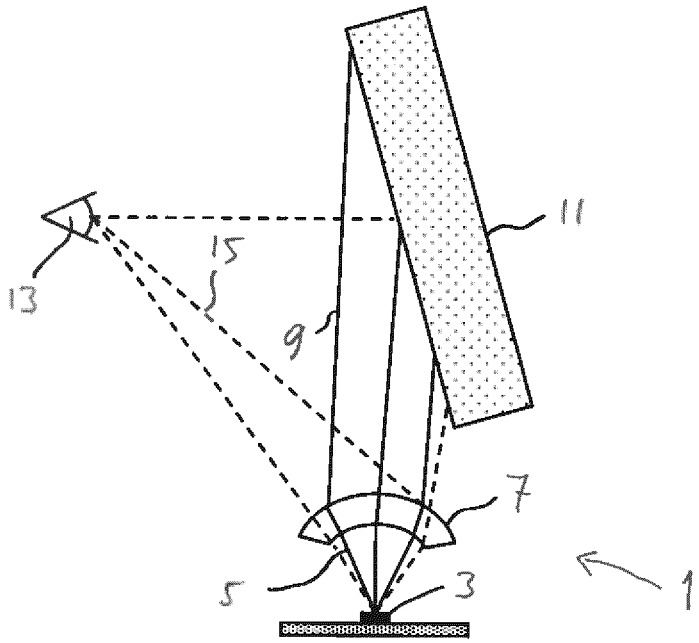
FIGS. 1A-B show the prior art illumination device and its appearance when applied in a refrigerator application.
Figure 1B:
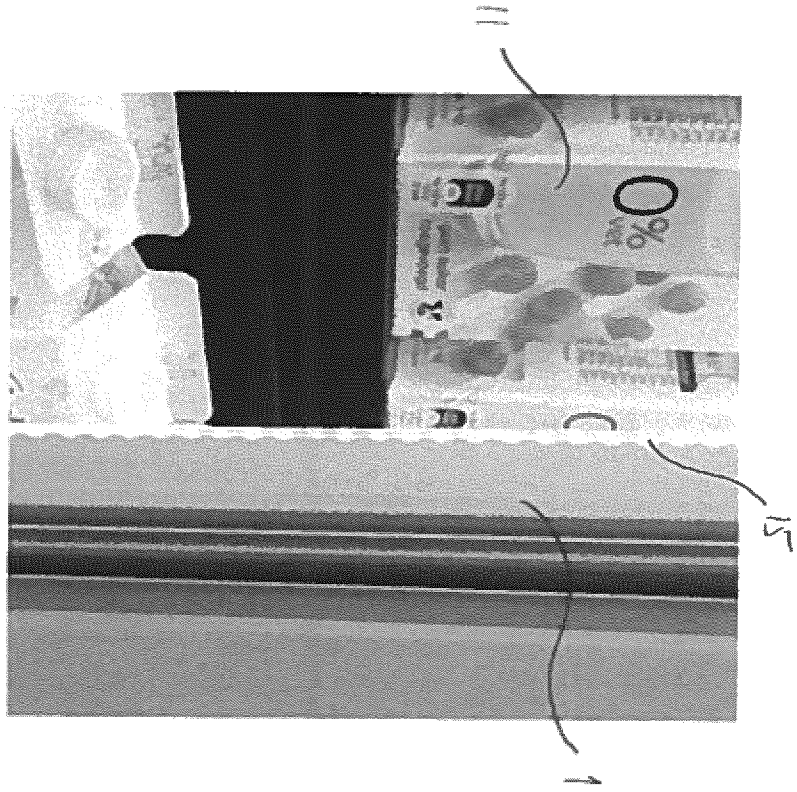

FIG. 1A-B show the prior art illumination device 1 and its appearance when applied in a refrigerator application. The illumination device comprises a plurality of light sources 3, in the figure a LED strip which issues light 5, i.e. light source light, with a Lambertian beam profile during operation. A cylindrical lens 7 is mounted over the LED strip. The cylindrical lens has dome shaped transversal cross section and deflects light source light as a (relatively) narrow beam of deflected light 9 from the LED strip towards an object 11. In the FIG. 1A-B the object is merchandise, but the object could, for example, alternatively be a wall, a shelve or a painting. The merchandise illuminated by the light source is visible by a customer 13. However, the customer is also distracted by the light source as because of a negative side-effect of illumination of the merchandise, both the light source itself as well as a reflected image 15 thereof in the lens are visible by the customer. This negative side-effect is shown in FIG. 1B and is often referred to by customers as the "Christmas tree" effect because of its dotty appearance.

Figure 2A:
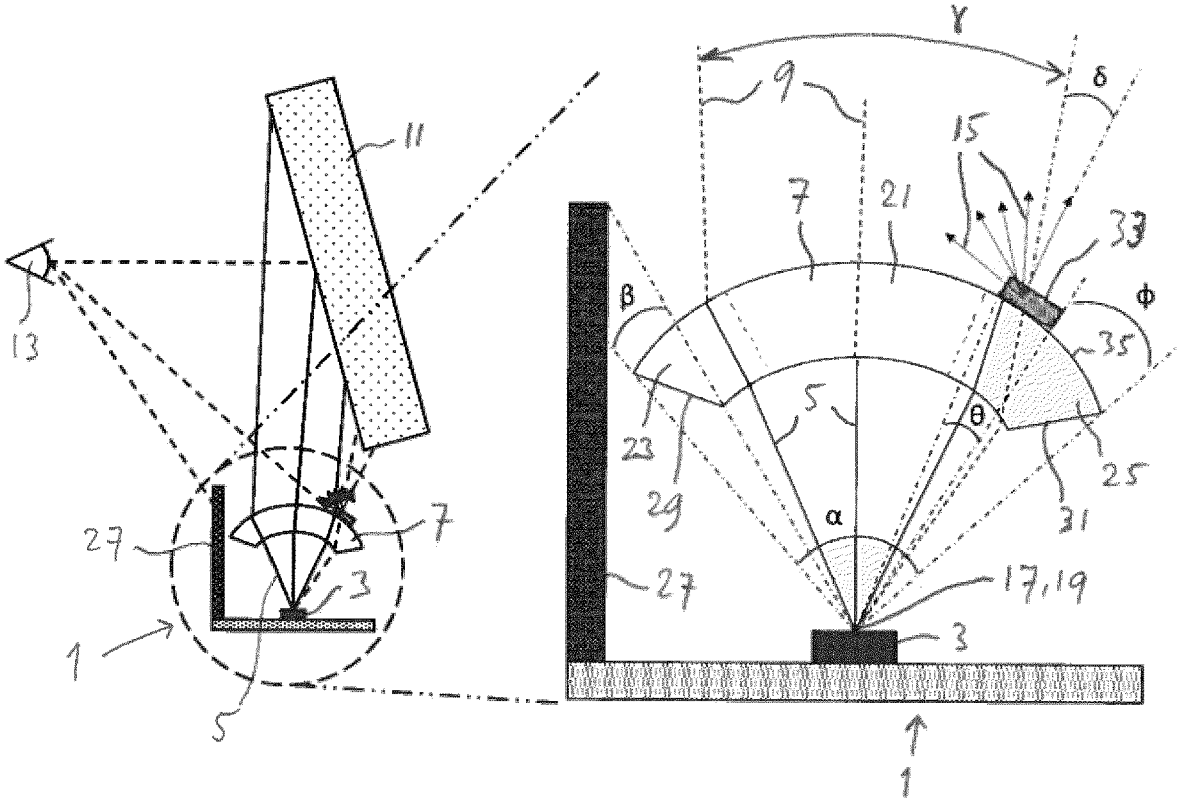
FIGS. 2A-B show a first embodiment of an illumination device according to the invention and its appearance when applied in a refrigerator application.
Figure 2B:
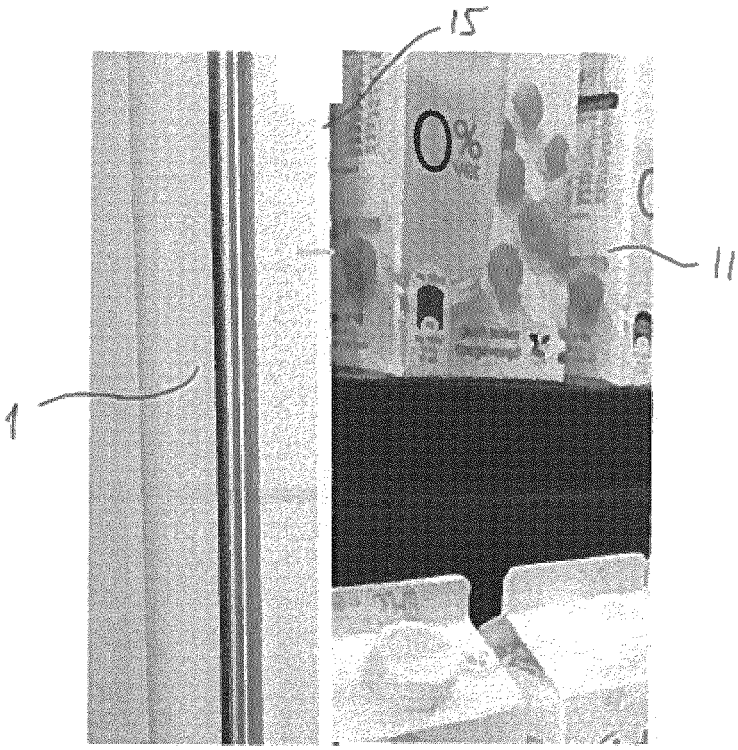

FIG. 2A-B show a first embodiment of an illumination device 1 according to the invention and its appearance when applied in a refrigerator application. The illumination device comprises a plurality of light sources 3 which issues light, i.e. light source light 5, with a Lambertian beam profile during operation. The light source is an axially extending LED strip along a main axis 17 (perpendicular to the paper). An axially extending cylindrical lens 7 is mounted over the LED strip, such that the LED strip is positioned on a focal line 19 of the cylindrical lens, coinciding with the main axis which collimates or deflects the Lambertian beam profile into a deflected light beam 9 having a beam angle $\gamma$ of about 15° at FWHM. The lens has a central portion 21, flanked by a first side portion 23 and a second side portion 25. In transverse direction the cylindrical lens has a dome shaped cross section extending over an angle $\alpha$ of about 90° over the LED strip, and deflects light source light as a (relatively) narrow beam of deflected light 9 from the LED strip towards merchandise 11. The merchandise illuminated by the light source is visible by a customer 13. A direct view of the light source by customers is blocked by an axially extending screen 27 disposed adjacent to the first side portion of the lens which screen the dome from a first outer edge 29 over an angle ß of about 15°. The cause of glare to a customer by a clear reflected image 15 of the light source (LED die) in the second side portion of the lens is counteracted in that an axially extending diffuser 33, in the figure a white tape, is provided at an outer surface 35 of the lens at the second side portion. The white tape starts from a second outer edge 31 of the lens at an angle $\varphi$ of about 20° and extends over an angle $\Theta$ of about 10°. The angles $\alpha$, ß, $\varphi$, and $\Theta$ are all determined with respect to rotation over the focal line. The white tape diffuses a part of the deflected light source light and causes a small beam broadening $\delta$ of about 3° (determined with respect to rotation over the white strip). As shown in FIG. 2B, it is thus attained that a more visually attractive continuous light line is formed as a reflected image 15 of the light strip, instead of a distracting visible dotted line.

Figure 3A:
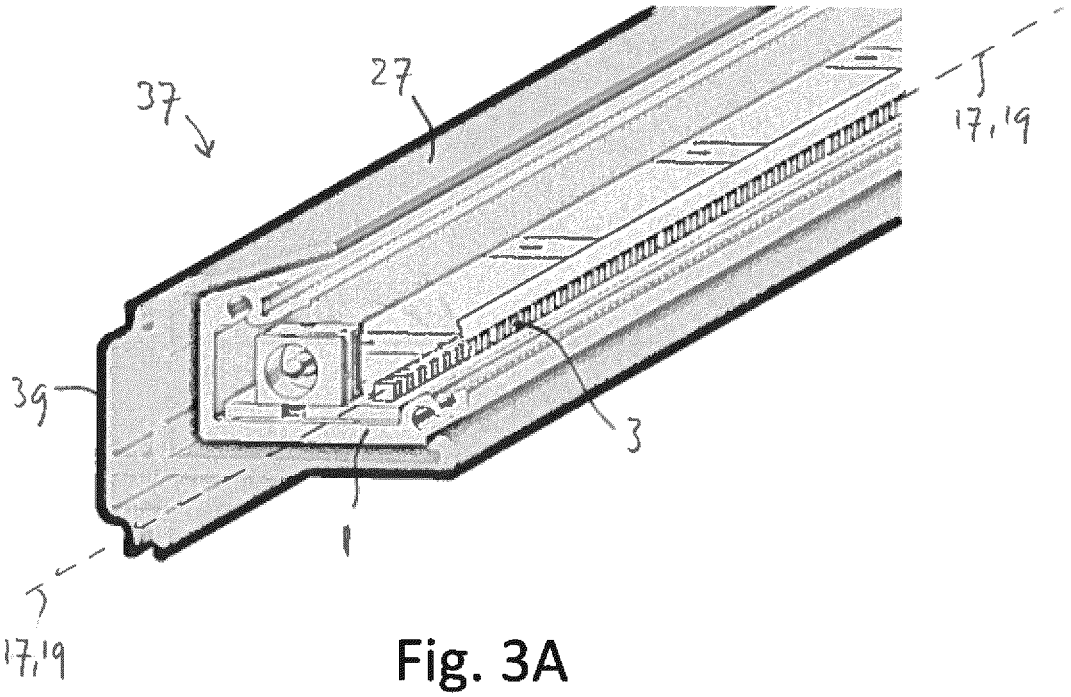
FIGS. 3A-B respectively show a perspective view and a transversal cross-section of a luminaire comprising a second embodiment of an illumination device according to the invention.
Figure 3B:
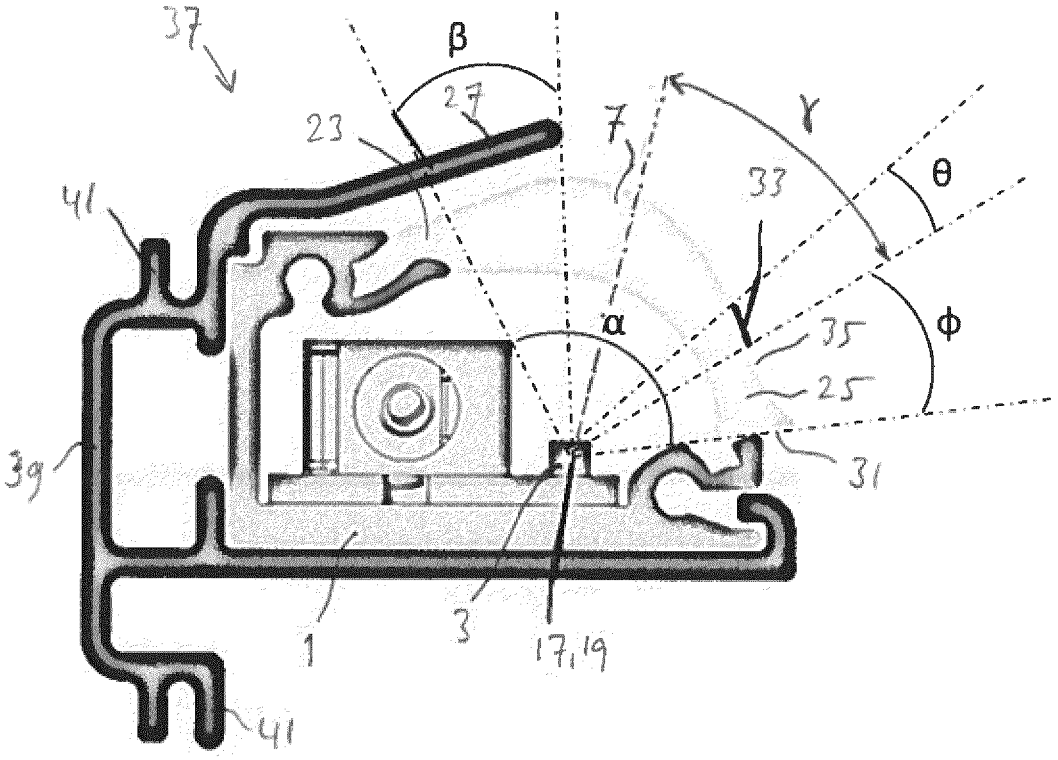

FIG. 3A-B respectively show a perspective view and a transversal cross-section of a luminaire 37 comprising a second embodiment of an illumination device 1 according to the invention.

The luminaire comprises an elongated housing 39 which extends along a main axis 17. The housing accommodates the illumination device and comprises fixation means 41, in the figure mounting ridges, but which alternatively or additionally could be screws, bolts, magnets or snap features. The illumination device comprises an axially extending LED strip 3 arranged on a focal line 19 of an axially extending cylindrical lens 7, dome shaped in a transverse cross section, and extending axially over the LED strip. Viewed in cross section the dome shape extends over an angle $\alpha$ of about 115°, wherein the Lambertian emission profile of the LED is transformed into a deflected beam having a beam angle $\gamma$ of about 45° at FWHM. The illumination device further comprises an axially extending screen 27 at a first side portion 23 of the cylindrical lens, which screen is an integral part of the housing of the luminaire. The screen screens the cylindrical lens over an angle ß of about 25° of the dome shaped cross section. As an axially extending diffuser 33 the lens comprises at a second side portion 25 at an outer surface 35 thereof facing away from the LED strip, a spray coating. The spray coating starts from the second outer edge 31 of the lens at an angle $\varphi$ of about 25° and extends over an angle $\Theta$ of about 10°.

Figure 4A:
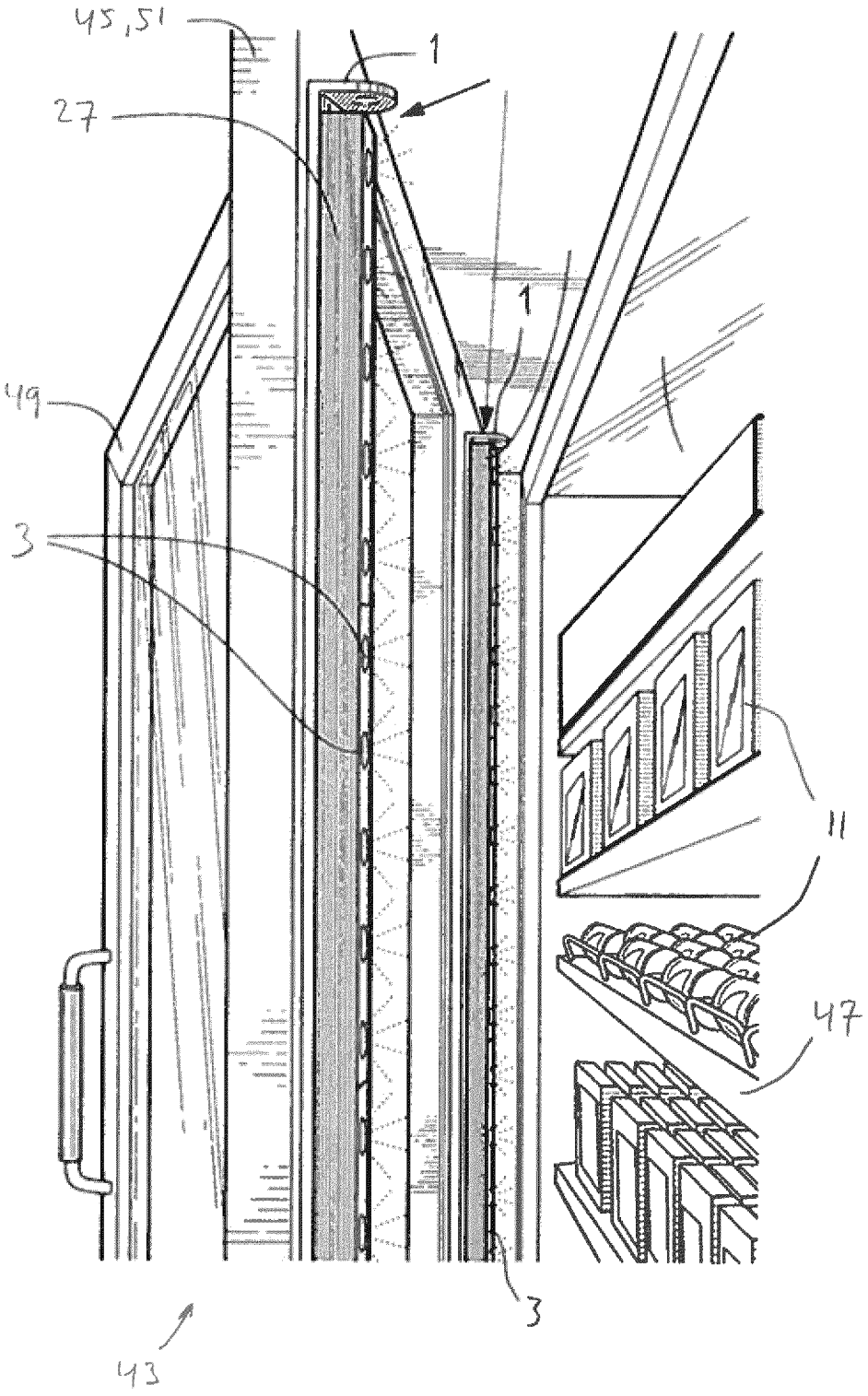
FIGS. 4A-B show a refrigerator comprising two illumination devices according to the invention.
Figure 4B:
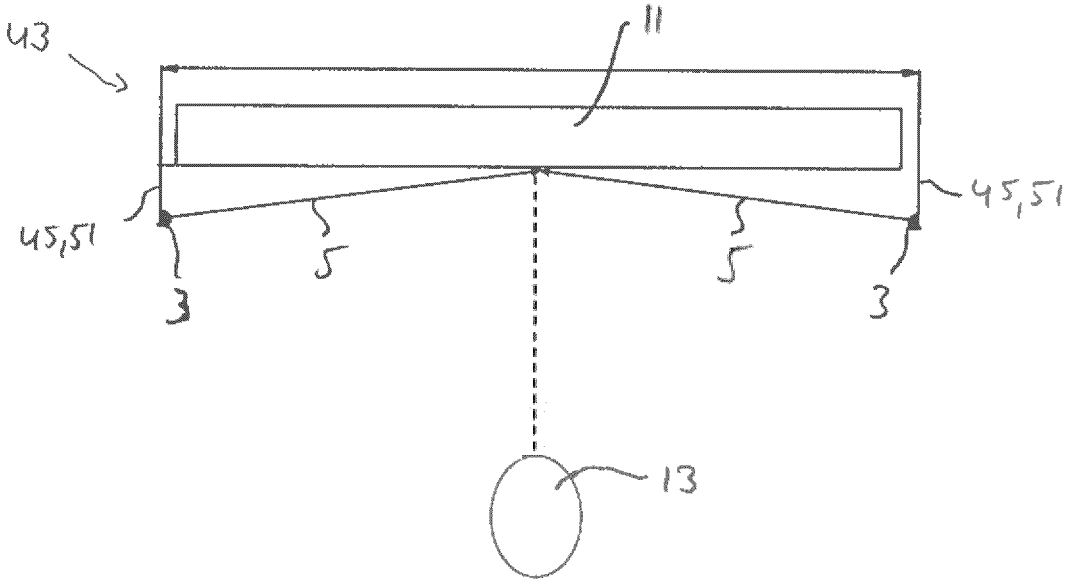

FIG. 4A-B show a refrigerator 43 comprising two illumination devices 1 according to the invention. In FIG. 4A, the illumination devices each comprising a LED strip 3, is illustrated attached to a door frame 45 of the refrigerator. Refrigerated merchandise 11 is stored on shelves 47 in the refrigerator behind glass display doors 49 for display to customers 13. When a customer approaches the refrigerator, a built-in sensor of the refrigerator detects the presence of a customer and will send a signal to a controller (not visible) to switch on the illumination device to illuminate the merchandise. In the figure the LEDs are shown as individual spots because the doors are in slightly opened position, but these LEDs will be seen as a continuous line of light when the doors of the refrigerator are closed due to the illumination device comprising the screen 27 and the diffuser (not shown). Two illumination devices are installed on the door frame between each of the refrigerator doors and is typically about 1.20 meter from adjacent door posts 51. In the illustrated embodiment, light is emitted from each of the individual LEDs carried by the illumination device and refracted by the lens (not shown) to provide an evenly distributed and desirable light pattern for uniform illumination of the merchandise displayed in the refrigerator. Typically, the door of refrigerator is lined with glass so that customers can view the merchandise in the refrigerator prior to opening the door. A plurality of LEDs is generally necessary to provide sufficient lighting to uniformly illuminate the interior of the refrigerator. As illumination devices are installed on both sides of the door frame, as shown in FIG. 4B, the merchandise can be illuminated from two opposite directions. As each illumination device is individually controllable, with each LED thereof being individually controllable, a desired color distribution and light intensity distribution can be chosen for optimal illumination of the displayed merchandise.

Figure 5:
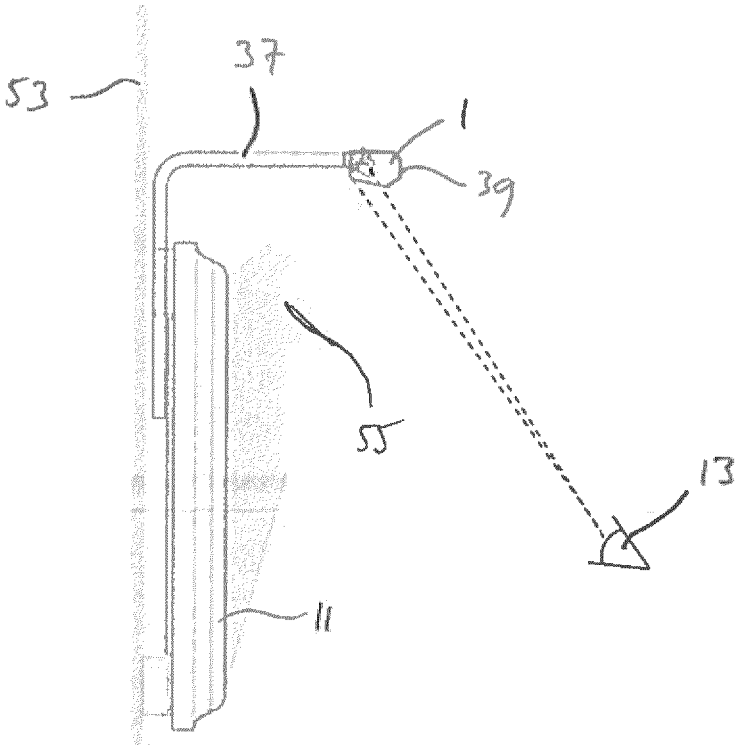
FIG. 5 shows a luminaire comprising an illumination device according to the invention.

FIG. 5 shows a luminaire 37 comprising an illumination device 1 according to the invention. The luminaire is mounted onto a wall 53 with a housing 39 which accommodates an illumination device. The illumination device is oriented in such a manner in the housing that it provided grazing light 55 to the wall, for a wall washing effect and to illuminate an object 11 hanging on said wall, for example a painting. As the illumination device comprises a screen and a diffuser (not visible) neither the individual LEDs nor reflected images of the LEDs of the LED strip of the illumination device are visible to a viewer 13.

The invention claimed is:

1. Illumination device comprising:

a dome-shaped, cylindrical lens having an optical focal line defining a main axis;

a plurality of light sources arranged along the main axis and configured to emit light during operation;

said lens being disposed to receive and to deflect said light as a light beam having an angle $\gamma$ at FWHM in a direction transverse to the main axis, wherein preferably $0° <= \gamma <= 45°$, in transversal cross section the cylindrical lens comprises a central portion flanked by a first side portion and a second side portion;

an axially extending screen disposed adjacent to the first side portion; and an axially extending diffuser provided at the second side portion, wherein the cylindrical lens comprises an inner lens surface facing towards the plurality of light sources and an outer lens surface facing away from the light sources and wherein the diffuser is at least provided on the outer lens surface, wherein the second side portion has an axially extending second outer edge and wherein with respect to rotation over the focal line the diffuser forms a diffuser area which starts at angle $\varphi$ from said second outer edge, wherein $0° <= \varphi <= 40°$, and wherein the diffuser area extends over angle $\Theta$, wherein $5° <= \Theta = 15°$.

2. Illumination device as claimed in claim 1, wherein each of the plurality of light sources is positioned on the focal line and each light source has a respective optical axis extending through the cylindrical lens in a direction transverse to the main axis.

3. Illumination device as claimed in claim 1, wherein with respect to rotation over the focal line, the dome shaped lens extends over the plurality of light sources over angle $\alpha$, wherein $90° <= \alpha <= 160°$.

4. Illumination device as claimed in claim 1, wherein the first side portion has an axially extending first outer edge, and wherein with respect to rotation over the focal line the screen screens the dome from the first outer edge over an angle $\beta$, wherein $10° <= \beta <= 50°$.

5. Illumination device as claimed in claim 1, wherein $10° <= \varphi <= 30°$ and wherein $8° <= \Theta <= 12°$.

6. Illumination device as claimed in claim 1, wherein the diffuser comprises at least one of a white powder coating, a white tape, a white spray-coating, a sandblasted and an etched surface structure.

7. Illumination device as claimed in claim 1, wherein the cylindrical lens is an extruded lens and wherein the diffuser is a co-extruded component.

8. Illumination device as claimed in claim 1 further comprising a reflector having a reflective surface facing towards the lens, wherein said reflector is arranged adjacent to the second side portion and wherein the diffuser is additionally provided on said reflective surface.

9. Illumination device as claimed in claim 1 wherein the diffuser is an anisotropic diffuser having a degree of diffusion in the main direction higher than the degree of diffusion in the transverse direction.

10. Illumination device as claimed in claim 1, wherein the diffuser has a beam widening effect of widening the beam by an angle $\delta$, wherein $1° <= \delta <= 5°$.

11. Luminaire comprising a housing accommodating the illumination device as claimed in claim 1 and further comprising fixation means for mounting the luminaire to a carrier.

12. Refrigerator comprising a refrigerator door frame, a refrigerator compartment comprising at least one shelve and lidded by a refrigerator door, wherein the illumination device as claimed in claim 1 and/or the luminaire mounted onto a first vertical post of the door frame for illuminating from a first direction a front part of the shelve closest to the refrigerator door.

13. Refrigerator as claimed in claim 12 comprising a further illumination device or a luminaire mounted onto a second vertical post, opposite to the first vertical post, for illuminating from a second direction, opposite to the first direction, the front part of the shelve closest to the refrigerator door.

* * * * *